United States Patent [19]

Sanders

[11] Patent Number: 4,915,659

[45] Date of Patent: Apr. 10, 1990

[54] WATER SKI ALSO ADAPTED FOR USE ON LAND

[76] Inventor: Rock A. Sanders, 1563 Bridgegate St., Westlake Village, Calif. 91361

[21] Appl. No.: 208,108

[22] Filed: Jun. 17, 1988

[51] Int. Cl.[4] ..... A63C 15/03

[52] U.S. Cl. ..... 441/76; 440/17; 441/77

[58] Field of Search ..... 441/76, 77, 73; 280/817, 819; 440/13, 17

[56] References Cited

U.S. PATENT DOCUMENTS

| | | | |
|---|---|---|---|
| 2,651,790 | 9/1953 | Geiger | 441/76 |
| 3,063,071 | 11/1962 | Van Vorst | 441/77 |
| 3,112,504 | 12/1963 | Carlton | 441/77 |
| 3,601,828 | 8/1971 | Fairchild | 441/76 |
| 3,808,622 | 5/1974 | Webster | 441/77 |
| 3,835,494 | 9/1974 | Dougherty | 441/77 |

FOREIGN PATENT DOCUMENTS

| | | | |
|---|---|---|---|
| 118958 | 9/1984 | European Pat. Off. | 441/76 |
| 2493163 | 5/1982 | France | 441/76 |

*Primary Examiner*—Sherman D. Basinger
*Assistant Examiner*—Thomas J. Brahan
*Attorney, Agent, or Firm*—Max Geldin

[57] ABSTRACT

A water ski also adapted for walking on land is disclosed. The ski comprises a pontoon of generally streamlined shape, formed of a lightweight rigid material, and a plurality of spaced cups of a flexible material attached to the lower surface of the pontoon, each of the cups being open at the rear end thereof to form a pocket to receive water and provide water resistance against the backward movement of the pontoon, the cups closing against the lower surface of the ponton by the action of the water during the forward motion of the pontoon to reduce drag. According to one embodiment, a plurality of fins are disposed longitudinally along its lower front portion of the pontoon and extending below the cups in the closed position thereof, and an additional fin or runner is disposed longitudinally along the lower rear portion of the pontoon and extending below the cups in the closed position thereof. The fins or runners provide for stability and guidance of the pontoon in the water and particularly function to provide support to permit the user to walk with a pontoon in shallow water or on a solid surface, such as sand, hard soil, concrete and the like, without damaging the rubber cups on the lower surface of the pontoon. Preferably, the fins are provided with a ridge or shoulder at the rear portion thereof to provide traction, particularly when walking in sand or loose dirt.

10 Claims, 2 Drawing Sheets

FIG. 5
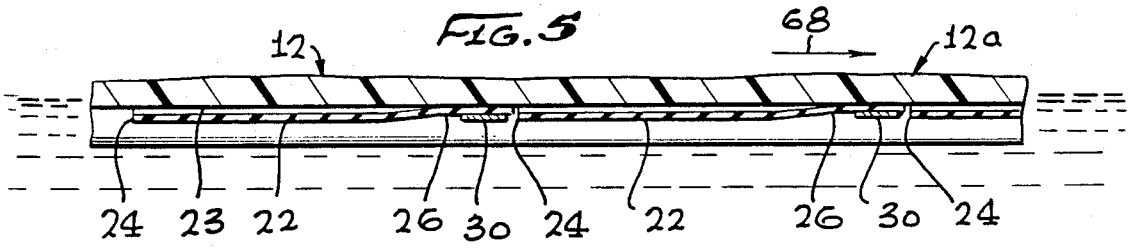
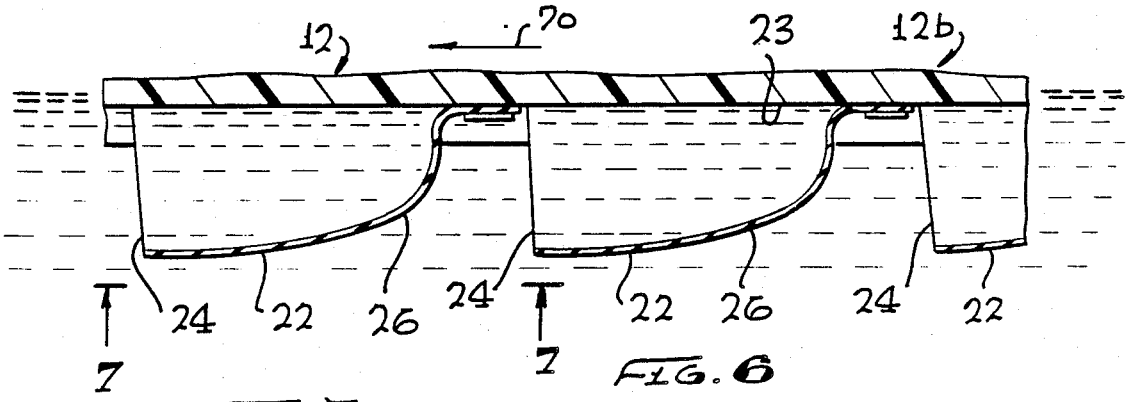
FIG. 6
FIG. 7
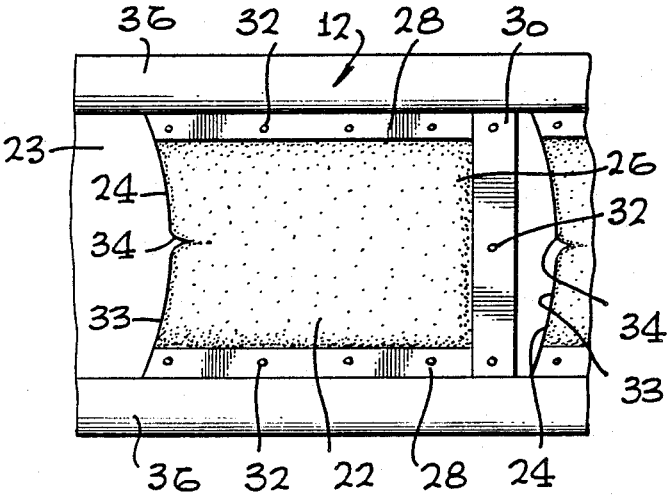
FIG. 11
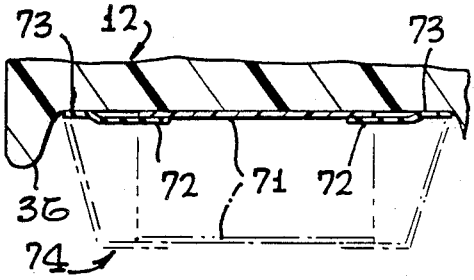
FIG. 9
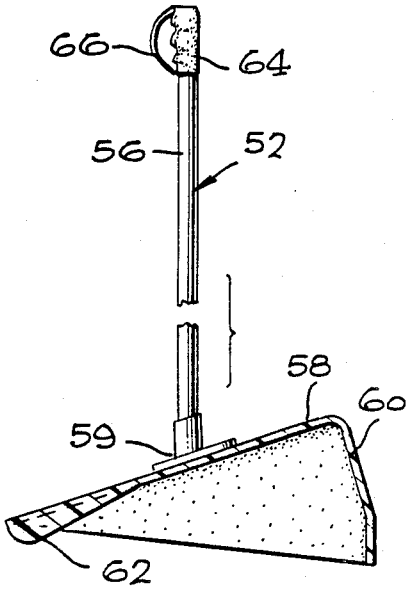
FIG. 8
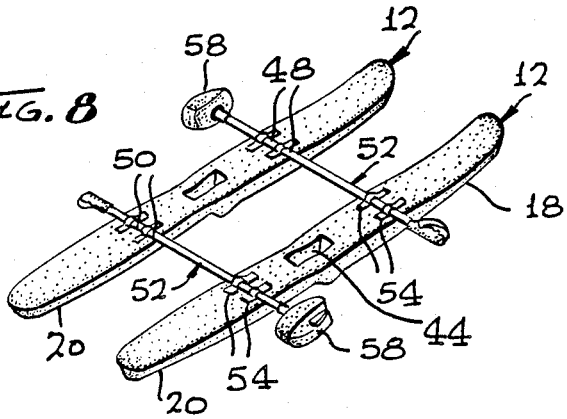

WATER SKI ALSO ADAPTED FOR USE ON LAND

BACKGROUND OF THE INVENTION

This invention relates to an improvement in water skis and is particularly directed to versatile water ski structures which have improved stability in the water and which permit the user to walk on solid surfaces, such as sand, hard ground or ice, without damaging the skis for use in water.

Water skis for walking on the surface of water for sport or recreational purposes are known. Thus, it is known to provide water skis in the form of pontoons with rubber cup-shaped contractible fins on the underside thereof, which are used to provide traction to the user while walking on the water, to allow the pontoons to progress forward. This is accomplished by the fins reacting against the water to prevent backward movement of the pontoon.

Examples of such water skis are found in U.S. Pat. No. 2,694,209 and Canadian Pat. Nos. 736,381 and 961,063.

However, such prior art water skis do not have good stability and are not easily guided by the user when walking on the water. Further, it is difficult for the user to walk with the skis on sand, such as beach sand, or on dry land, particularly without damaging the rubber fins on the bottom of the pontoons.

Further, if the user falls off the water skis, it is difficult to remount such skis while in the water.

One object of the present invention is to provide improved water skis of the above general type, which have greater stability and permit easier guidance by the user when walking on the water.

Another object is to provide improved water skis of the above type which also permit the user to walk on sand, loose dirt or land, and on ice, readily and without damaging the rubber cups on the under portion of the skis.

A still further object is to provide improved skis of the above type provided with means to permit a pair of the skis to be joined together so that there is no relative movement with respect to each other, thereby permitting the user to mount the skis readily while they are in the water.

SUMMARY OF THE INVENTION

According to the invention, there is provided water skis also adapted for walking on land, each of which comprises a pontoon of generally streamlined shape, formed of a lightweight rigid material, and a plurality of spaced cups of a flexible material attached to the lower surface of the pontoon, each of the cups being open at the rear end thereof to form a pocket to receive water and provide water resistance against the backward movement of the pontoon, the cups closing against the lower surface of the pontoon by the action of the water during the forward motion of the pontoon to reduce drag.

According to an important feature of the invention, a plurality of fins or runners are disposed longitudinally along at least a portion of the lower surface of the pontoon and extending below the cups in the closed position thereof. Preferably, two of such fins are disposed longitudinally along the lower front portion of the pontoon and extending below the cups in the closed position thereof, and an additional fin or runner is disposed longitudinally along the lower rear portion of the pontoon and extending below the cups in the closed position thereof. The fins or runners provide for stability and guidance of the pontoon in the water and particularly function to provide support to permit the user to walk with a pontoon in shallow water or on a solid surface, such as sand, hard soil, concrete and the like, without damaging the rubber caps on the lower surface of the pontoon.

The fins are formed integral with the body portion of the pontoon and are of a streamlined configuration. Preferably, the fins are provided with a ridge or shoulder at the rear portion thereof to provide traction, particularly when walking in sand or loose dirt.

The pontoons are each provided with a cavity positioned approximately centrally in the upper portion of the pontoon body for insertion of the wearer's foot, and means are provided in the cavity for attaching the foot for using the skis.

As an additional feature of the invention, means are included on the upper surface of the front and rear portions of the pontoon for attachment of a pair of ski poles across a pair of pontoons, to connect the pontoons together and prevent relative movement with respect to each other. This latter feature makes for a unitary structure so that the user can readily mount the skis while they are in the water. This arrangement also serves as a convenient means for carrying the skis.

The above and other objects and advantages of the invention will be made apparent from the following description of certain preferred embodiments thereof, taken in connection with the accompanying drawings.

DESCRIPTION OF THE DRAWINGS

FIG. 5 is a longitudinal central section of the ski, taken on line 5—5 of FIG. 4*a;*

FIG. 6 is a longitudinal central section of the invention water ski, taken on line 6—6 of FIG. 4*b;*

FIG. 7 is an enlarged partial bottom view of the invention ski, taken on line 7—7 of FIG. 6;

FIG. 8 shows a pair of the invention skis joined together and held in fixed side-by-side relation by a pair of ski poles attached transversely across the front and rear portions of the skis;

FIG. 9 is an elevational view of a preferred ski pole for use with the invention skis;

FIG. 11 is an end view of the modification of FIG. 10, taken on line 11—11 of FIG. 10.

DETAILED DESCRIPTION OF PREFERRED EMBODIMENTS OF THE INVENTION

Figure 1:
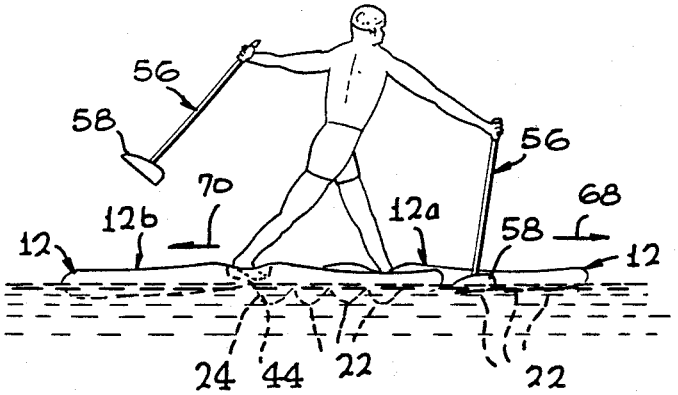
FIG. 1 illustrates use of the invention skis for walking on water.

Referring to FIGS. 1–6 of the drawings, the water ski of the invention, indicated at numeral 12 in the drawings, is in the form of a pontoon having a body portion 14 comprised of a lightweight rigid material, such as a suitable plastic foam, for example, styrofoam, which can be coated with a suitable coating, such as a polyurethane resin and fiberglass, if desired. Other suitable materials can be employed, such as wood.

The pontoon 12 has a generally long rectangular shape with a front portion 18 and a rear portion 20, the front forward portion being tapered at 19 to provide a streamlined configuration. The pontoon 12 in the present embodiment is solid, and the pontoon is large enough to support the weight of the user without drawing too much water.

A plurality of spaced cups 22 formed of a flexible or resilient material, e.g., flexible rubber, are attached to the lower surface 23 of the front portion 18 of the pontoon. The cups are disposed longitudinally and centrally along the lower surface of the front portion 18. Such cups are open at the rear end 24 thereof and closed at the opposite front end 26. The closed end 26 of one of the cups is disposed adjacent the open end 24 of the next forwardly positioned cup, as seen more clearly in FIGS. 5 and 6.

As shown in FIG. 7, the cups 22 are attached to plates 28 and 30 connected longitudinally and transversely to the lower surface of the front portion of the pontoon by means of suitable fasteners 32. The rear open portion 24 of each cup has a slightly curved configuration at 33 and has a central V-shaped notch 34 to facilitate and insure opening and expansion of the cup when water passes into its open end. The cups are preferably formed of a flexible material, e.g., resilient rubber.

Figure 3:
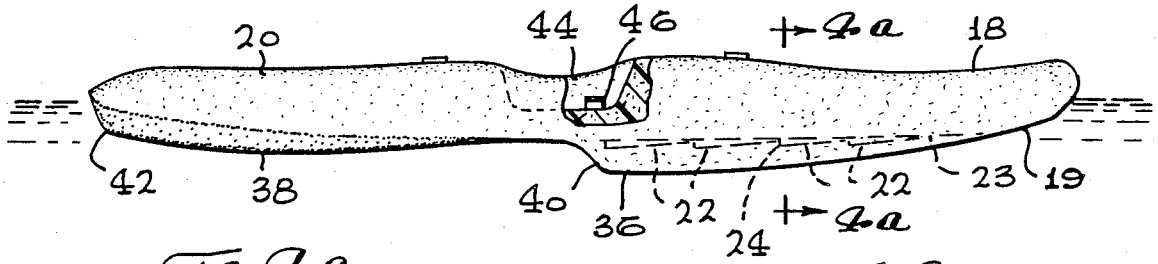
FIG. 3 is a side view of the invention ski.
Figure 4A:
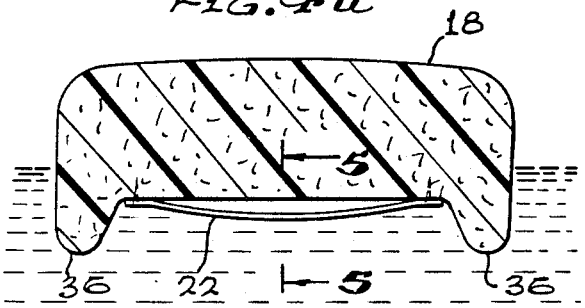
FIG. 4*a* shows a transverse section of the invention water ski, taken on line 4*a*—4*a* of FIG. 3, with the resilient cups in essentially closed position during forward advance of the ski.
Figure 4B:
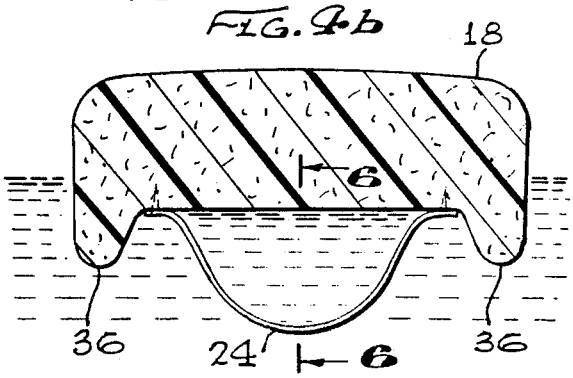
FIG. 4*b* is a cross-section of the ski, similar to FIG. 4*a*, but showing the resilient cups in expanded position to provide traction against backward movement of the ski.

A pair of rigid fins or runners 36 are integrally formed on the body portion of the pontoon and extend longitudinally along opposite sides of the lower front portion 18 of the pontoon between the cups, the fins or runners 36 extending below the cups in the closed position thereof, as illustrated in FIG. 4*a*. It will be noted that the fins 36 are forwardly streamlined and extend rearwardly to about the central portion of the pontoon, as indicated in FIGS. 2 and 3.

Figure 3A:
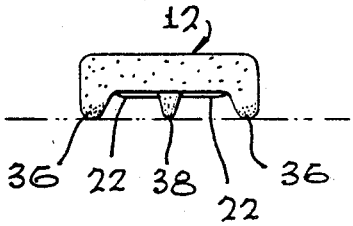
FIG. 3*a* illustrates the ski of the invention when used for walking on land.

An additional third rigid fin or runner 38 is disposed longitudinally and centrally along the lower rear portion 20 of the pontoon and is also integral with the body of the pontoon. The central fin 38 tapers at 39 forward toward the center of the pontoon in streamlined fashion and extends downwardly for about the same distance as the two forward fins 36, as shown in FIG. 3*a*, and also extends below the cups 22 in the closed position thereof.

Since the fins 36 and 38 are formed integral with the body portion of the pontoon, they are comprised of the same material as the body portion, e.g., styrofoam.

Figure 2:
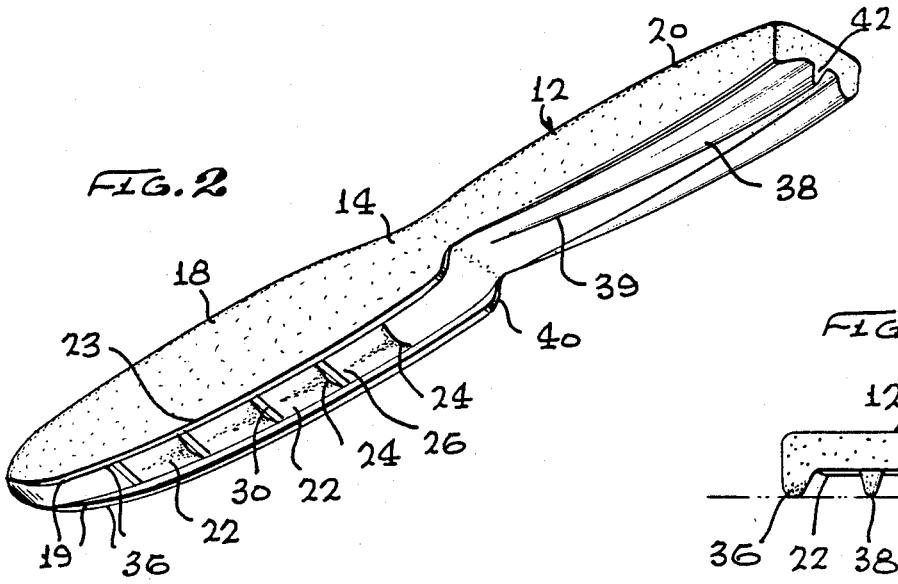
FIG. 2 is a perspective view of the invention ski of FIG. 1, showing the bottom and one side thereof.

It will be noted, as seen in FIGS. 2 and 3, that the front fins 36 are each provided at the rear portion thereof with a ridge 40, and the additional rear fin 38 is also provided with a similar ridge 42 at the rear portion thereof so as to provide traction when walking on sand, as described in greater detail hereinafter.

A relatively large cavity 44 is formed in the upper approximately central portion of the pontoon between the front and rear portions 18 and 20 thereof, and a suitable means for attaching the foot of the user, such as a conventional foot harness, indicated at 46, is provided in the cavity. Such foot harness can be in the form of a conventional water ski boot.

Referring to FIG. 8 of the drawings, a first pair of grooves 48 positioned transversely adjacent to each other are provided in the front portion 18 of the pontoon 12, and a second pair of similar grooves 50 are provided transversely adjacent each other in the rear portion 20 of the pontoon. A pair of ski poles 52 can be received in the grooves 48 and 50, respectively, of a pair of pontoons 12 and suitable clips or straps 54 provided over each of the grooves 48 and 50 for fastening the ski poles in the grooves and maintaining the two pontoons 12 in fixed parallel relation to each other for the purposes set forth hereinafter.

Referring to FIG. 9 of the drawings, the pontoons 12 of the invention can be utilized with ski poles of the type indicated at 52, comprised of a metal pole 56 having a buoyant cupped plunger-type member 58 suitably attached at 59 to the lower end of the pole. The member 58 can be formed of a plastic or resilient material and is cupped at its front end 60 in the nature of a plunger to afford greater propulsion when pushing forward, and is provided with a bracket 62 at its rear portion to release suction and permit easy release from the water when desired. The upper end of the ski pole 56 is provided with a handle 64 and a safety strap 66. The skis of the invention can be used with or without the specific ski poles 52.

In use, as for walking on water, the wearer harnesses each foot in attachment strap 46 within the cavity 44 of a pair of pontoons 12, and on forward movement of one of the pontoons 12, as indicated at 12*a*, in the direction indicated by the arrow 68, as shown in FIGS. 1 and 5, the rubber cups 22 thereof are essentially folded up and lie relatively flat loosely against the bottom of the pontoon, as indicated more clearly in FIGS. 4*a* and 5, to permit smooth forward movement of the pontoon, substantially without any resistance. During such forward movement of the pontoon 12*a*, the rubber cups 22 of the other pontoon 12*b* open up at the rear end 24 thereof to form a pocket to receive and catch the water, as shown more clearly in FIGS. 4*b* and 6, to provide water resistance and traction against the backward movement of pontoon 12*b* in the direction indicated by arrow 70 in FIGS. 1 and 6.

The fins 36 and 38 function to provide greater stability of the two pontoons 12*a* and 12*b* during such water walking and also facilitate guidance of the pontoons by the user in a forward or other desired direction, without slipping sideways.

The fins 36 and 38 have an additional important function in permitting the user to walk with the pontoons in sand, on loose soil and on hard surfaces, such as concrete or even ice, as illustrated in FIG. 3*a*, without damaging the expandable cups 22 in the closed position thereof since, as noted above, the fins depend below the resilient cups 22 in the closed position thereof, as illustrated in FIGS. 3*a* and 5.

When walking with the pontoons in sand or loose dirt, the ridges 40 and 42 at the rear of fins 36 and 38 dig into the sand and aid in providing traction to go forward, without sliding backwards.

Referring to FIG. 8, if the user falls off the skis in the water, he can then connect the skis together by inserting the poles in the grooves 48 and 50 of the skis, with the skis in parallel position, and fasten the straps 54, to form in effect a raft, enabling the user to climb aboard the skis while they are in the water and then disengage the ski poles. The arrangement shown in FIG. 8 with the poles and skis connected together also enables the user to carry or transport the interconnected skis and poles by lifting the entire arrangement manually by means of one or both ski poles 52.

Figure 10:
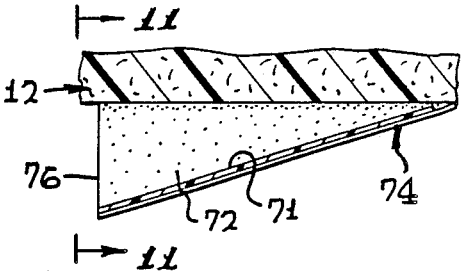
FIG. 10 illustrates use of a modified form of expandable cup with the skis of the invention, shown in open position to receive water for traction.

Various modifications of the water skis of the invention can be made. For example, as shown in FIGS. 10 and 11, instead of employing the cups 22 comprised entirely of a single piece of resilient or flexible rubber-like material, the cups 74 can be formed of a stiff bottom portion 71, e.g., comprised of plastic or other light-weight material, connected adjacent opposite edges thereof to resilient, e.g., flexible rubber pieces 72 which are mounted at their outer ends 73 on the bottom of the pontoon 12. In the closed position of the cups 74 formed of members 71 and 72, shown in FIG. 11, the bottom portion 71 is disposed closely adjacent the bottom of the pontoon as shown in the full-line position of members 71 and 72, but in the open position thereof to receive water and provide traction as noted above, the flexible sides 72 and the outer end 76 of the cup 74 expand to receive water, as shown in FIG. 10, the open end position of the cup 74 being shown in phantom lines in FIG. 11.

It will be understood that the number of expandable cups 22, the size thereof, and the thickness of the resilient material of which the cups are formed can be varied as desired with respect to different abilities and weights of the prospective users.

Further, the number of fins can be varied along with the position thereof so long as they function in the desired manner as described above. Thus, only one pair of fins 36 can be employed and extending over a substantial portion of the length of both the front and rear portions of the pontoon and omitting fin 38. Further, instead of employing two fins 36, with the cups 22 therebetween, there can be employed two fins 36 on each side of the pontoon, making a total of four such fins, two fins on each side of the cups 22. Further, if desired, in place of employing a single central fin 38, there can be employed a pair of such fins in side-by-side parallel relation. It will also be understood that the resilient cups 22 and the fins 36 on opposite sides thereof can be placed in the rear lower portion of the pontoon, and the central longitudinally extending fin 38 can be positioned in the front lower portion of the pontoon.

It is also understood that instead of forming the pontoon of a solid body of suitable lightweight plastic material, the pontoon can be formed of a hollow body of such material. In any case, the body of the pontoon should be of relatively large size for the displacement of water over a relatively large area.

From the foregoing, it is seen that the invention provides a novel ski construction having a variety of purposes. Thus, the skis can be employed as recreation for walking on water, or for running on water to provide exercise. They can also be used to provide a means of locomotion or transport across lakes or down rivers, and can also be used for walking across fields of snow or ice.

Since various further changes and modifications can be made in the invention without departing from the spirit thereof, the invention is not to be taken as limited except by the scope of the appended claims.

What is claimed is:

1. A water ski also adapted for walking on land, which comprises:

a pontoon of generally streamlined shape, a plurality of spaced cups of a flexible material attached to the lower surface of said pontoon, each of said cups being open at the rear end thereof to form a pocket to receive water on expansion of said cup to provide water resistance against the backward movement of said pontoon, said cups substantially closing against the lower surface of said pontoon by he action of the water during the forward motion of the pontoon to reduce drag, a plurality of fins disposed longitudinally along the lower front portion of said pontoon and extending below said cups in the substantially closed position thereof, said cups being positioned between said fins, said fins each having a ridge at the rear portion thereof to provide traction when walking in sand or loose dirt, an additional fin disposed longitudinally and centrally along the lower rear portion of said pontoon behind said ridges and extending below said cups in the substantially closed position thereof, said fins providing for stability and guidance of the pontoon in the water and providing support to permit walking with the pontoon on land, and means provided in the upper portion of said pontoon for attaching the user's foot.

2. The water ski of claim 1, said cups comprised of a resilient rubber-like material and being disposed longitudinally along the lower front portion of said pontoon, and employing a pair of said fins disposed longitudinally along the lower front portion of said pontoon on opposite sides thereof, said cups being disposed between said fins.

3. The water ski of claim 1, said pontoon having a body portion comprised of a lightweight rigid material, said fins being formed integral with said body portion, and having a streamlined configuration.

4. The water ski of claim 1, said additional fin terminating with a ridge at the rear portion thereof to provide further traction when walking in sand or loose dirt.

5. The water ski of claim 1, said pontoon comprised of a solid styrofoam body and said cups formed of flexible rubber.

6. The water ski of claim 1, including plates mounted on the lower surface of said pontoon, and means connecting said cups to said plates.

7. The water ski of claim 1, employing a pair of said fins positioned along opposite sides of said pontoon along the lower front portion thereof, said fins being forwardly streamlined and extending rearwardly to about the central portion of said pontoon, said additional central fin along the lower rear portion of the pontoon tapering forward toward the center of the pontoon.

8. A water ski also adapted for walking on land, which comprises:

a pontoon of generally streamlined shape and having a body portion formed of a lightweight rigid plastic foam, and having a front portion and a rear portion, a plurality of spaced flexible cups disposed longitudinally and centrally along the lower surface of said pontoon, each of said cups being open at the rear end thereof to form a pocket to receive water on expansion and provide water resistance against the backward movement of said pontoon, said cups having a notch along the rear edge thereof to insure opening, said cups substantially closing against the lower surface of said pontoon by the action of the water during forward motion of the pontoon to reduce drag, a plurality of rigid fins disposed longitudinally along the lower front portion of said pontoon and extending below said cups in the substantially closed position thereof, said fins positioned along opposite sides of said pontoon with said cups disposed between said fins, an additional fin disposed longitudinally and centrally along the lower rear portion of said pontoon and extending below said cups in the substantially closed position thereof, each of said fins having a streamlined configuration and being formed integral with the body portion of said pontoon and formed of the same material as the body of said pontoon, said fins providing for stability and guidance of the pontoon in the water and providing support to permit walking with the pontoon on land without damaging the cups in the closed position thereof, a cavity provided in the upper portion of said pontoon for the insertion of the user's foot, and means in said cavity for attaching the foot.

9. The water ski of claim 8, the body of said pontoon comprised of solid styrofoam and said cups formed of flexible rubber.

10. The water ski of claim 8, employing a pair of said fins positioned along opposite sides of said pontoon along the lower front portion thereof, said fins being forwardly streamlined and extending rearwardly to about the central portion of said pontoon, said additional central fin along the lower rear portion of the pontoon tapering forward toward the center of the pontoon.

* * * * *